US005692969A

United States Patent [19]

Schooler

[11] Patent Number: 5,692,969

[45] Date of Patent: Dec. 2, 1997

[54] ADJUSTABLE GOLF PUTTER

[76] Inventor: Paul T. Schooler, 16285 Erin, Fraser, Mich. 48026

[21] Appl. No.: 587,015

[22] Filed: Jan. 16, 1996

[51] Int. Cl.[6] ..... A63B 53/06

[52] U.S. Cl. ..... 473/313; 473/340; 473/248; 473/251

[58] Field of Search ..... 473/313, 340, 473/338, 339, 296, 307, 334, 246, 248

[56] References Cited

U.S. PATENT DOCUMENTS

| | | | |
|---|---|---|---|
| 1,515,998 | 11/1924 | Clark | 137/843 |
| 3,909,005 | 9/1975 | Piszel | 473/248 |
| 4,111,426 | 9/1978 | Goodwin | 473/260 |
| 4,133,535 | 1/1979 | Marsh | 473/258 |
| 4,881,737 | 11/1989 | Mullins | 473/248 |
| 5,348,295 | 9/1994 | Phillips | 473/307 |
| 5,390,920 | 2/1995 | Nickum | 473/246 |
| 5,415,399 | 5/1995 | Kettelson | 473/239 |
| 5,429,356 | 7/1995 | Dingle et al. | 473/251 |

FOREIGN PATENT DOCUMENTS 9169 1/1909 United Kingdom .

*Primary Examiner*—Sebastiano Passaniti
*Assistant Examiner*—Stephen L. Blau
*Attorney, Agent, or Firm*—Howard & Howard

[57] ABSTRACT

A putter having a head, the angle of which is adjustable relative to the shaft, includes a shaft having a lower end secured to a rotatable member rotatably disposed within a bore in the golf club head. The bore includes a longitudinally-elongate upper portion adjacent the upper surface of the head which restricts the range of motion of the shaft. The upper portion prevents movement of the shaft about the axis of the head and restricts the pivotal movement of the shaft to between about 30 degrees and 90 degrees relative to the head. A resilient locking member selectively locks and unlocks the rotatable member within the golf club head, thereby selectively permitting adjustment of the golf club shaft-head angle. Since the locking member is resilient, a golfer is able to adjust the angle merely by applying weight or force.

15 Claims, 1 Drawing Sheet

ADJUSTABLE GOLF PUTTER

BACKGROUND OF THE INVENTION

This invention relates to golf putters and more particularly to a golf putter wherein the angle of the head relative to the shaft is adjustable.

Golfers of different styles may prefer that the golf club head be mounted on the shaft of the golf club at different angles, generally between 30 and 90 degrees. Further, a single golfer may wish to vary the golf club head angle for a particular shot or terrain. This is particularly true for putters.

Several known golf clubs have attempted to provide a golf club wherein the angle of the head is adjustable relative to the shaft. One known golf club utilizes a shaft having a lower end terminating in a generally spherical pivot ball. The ball is disposed within a bore in the golf club head and is secured by a locking screw threaded into the bore. However, the pivot ball in the known golf club permits the shaft to rotate and pivot in any direction relative to the golf club head. Consequently, the inadvertent pivotal movement of the shaft about the axis of the golf club head causes the face of the golf club head to be tilted undesirably.

Another known golf club utilizes a golf shaft attached to a moveable sphere mounted within a pocket of a top portion of a putter head and seated within a first or second cavity in the bottom portion of the putter head. However, again, the inadvertent pivotal movement of the shaft about the axis of the golf club head causes the face of the golf club head to be tilted undesirably relative to the shaft.

A known golf club having an adjustable head includes a shaft having a hub at a lower end. A threaded bolt extends horizontally from the side of the head opposite the face. The bolt is inserted through the hub on the lower end of the shaft. A nut is threaded onto the bolt to secure the shaft to the head in the desired position. Because the shaft is secured to the side of the head, that side cannot be used to contact the golf ball.

All of the above described prior golf clubs are unduly complex and include many working parts. Moreover, most of these clubs have pivoting structure that enters into the top of the club head and is accessible to dirt, etc. This is undesirable.

SUMMARY OF THE INVENTION

The present invention provides a golf putter having a head, the angle of which is adjustable relative to the shaft. The purer also prevents the pivotal movement of the shaft about the axis of the head, i.e. the movement of the head relative to the shaft is restricted generally to a single plane which contains both the shaft and the axis of the head.

The inventive putter includes a shaft having a lower end pivotally secured to an upper surface of a head. The head is preferably generally cylindrical, having two convex faces and a flattened lower surface. The convex faces ensure proper line contact with the ball even with some slight fit of the putter by the golfer. The head includes a bore generally transverse to the upper surface of the head. The bore includes a longitudinally-elongate, narrow upper portion adjacent the upper surface of the head. A rotatable member comprises a stem portion extending from a ball portion. The ball portion of the rotatable member is rotatably disposed within the bore and the stem portion extends through the upper portion of the bore. The stem portion is inserted into the shaft. A locking member selectively locks and unlocks the rotatable member within the head, thereby selectively permitting adjustment of the shaft-head angle. While the locking member holds the shaft at a selected position, a golfer can easily adjust the angle by applying weight. In fact, the angle can be adjusted on the surface of the golf green by applying weight and tailoring the angle to a desired angle.

The motion of the shaft is restricted by the upper portion of the bore. The upper portion prevents pivotal movement of the shaft about the axis of the head, which would otherwise cause the face of the head to be tilted relative to the shaft. The upper portion also restricts the pivotal movement of the shaft to between about 30 degrees and 90 degrees relative to the head.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF A PREFERRED EMBODIMENT

Figure 1:
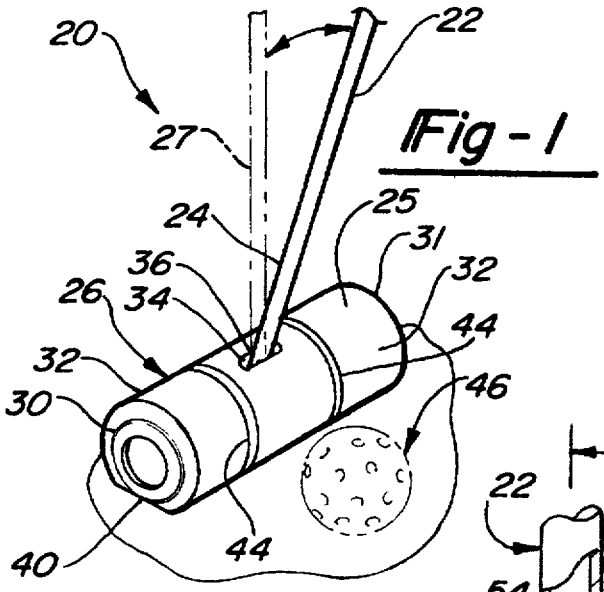
FIG. 1 is a perspective view of the adjustable putter according to the present invention.

An adjustable putter 20 according to the present invention is shown in FIG. 1. The inventive putter 20 includes a shaft 22 having a lower end 24 pivotally secured to an upper surface 25 of a head 26. The angle of the shaft 22 relative to the head 26 is selectively adjustable, generally up to a perpendicular position 27 (shown in phantom) perpendicular to the axis of the head 26.

The head 26 is preferably generally cylindrical having longitudinal ends 30, 31 and convex faces 32. The head 26 includes a bore 34 generally transverse to the upper surface 25 of the head 26. The bore 34 includes a longitudinally-elongated upper portion 36 adjacent the upper surface 25 of the head 26. The lower surface 40 of the head 26 is preferably flattened.

The putter 20 preferably includes a pair of guidelines 44 about the circumference of the head 26 generally representing one-third markers of the longitudinal length of the head 26. The guidelines 44 assist the golfer in properly hitting the golf ball 46 at the center of gravity of the head 26. The head 26 is preferably Delrin 500 CL, aluminum or other suitable material.

Figure 2:
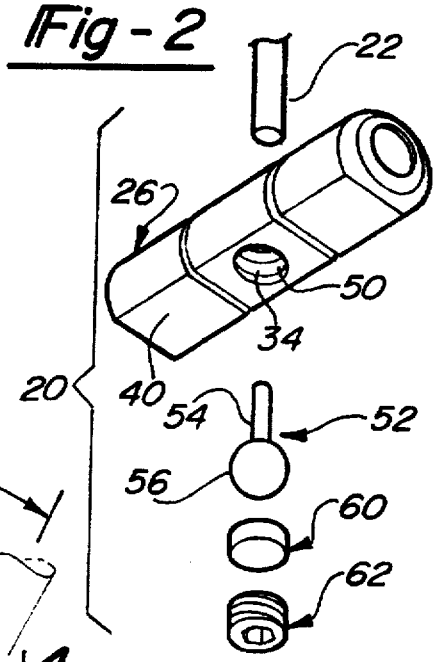
FIG. 2 is an exploded perspective view of the putter of FIG. 1.

As can be seen in FIG. 2, the bore 34 in the head 26 includes a threaded portion 50 adjacent the lower surface 40 of the head 26. Preferably, the threaded portion 50 of the bore 34 is ⅝" in diameter and has 18 threads per inch. The putter 20 further includes a rotatable member 52 generally comprising a stem portion 54 extending from a ball portion 56. Preferably, the ball portion 56 has a 9/16" diameter and the stem portion 54 has a 21/64" diameter. It should be understood that the ball portion 56 of the rotatable member 52 could also be cylindrical rather than spherical. The putter 20 further includes a ball joint seat or retainer 60 which is preferably generally a resilient plastic disk. Again, Delrin may be used. The putter 20 further includes a threaded locking member 62 such as a set screw 62.

Figure 3:
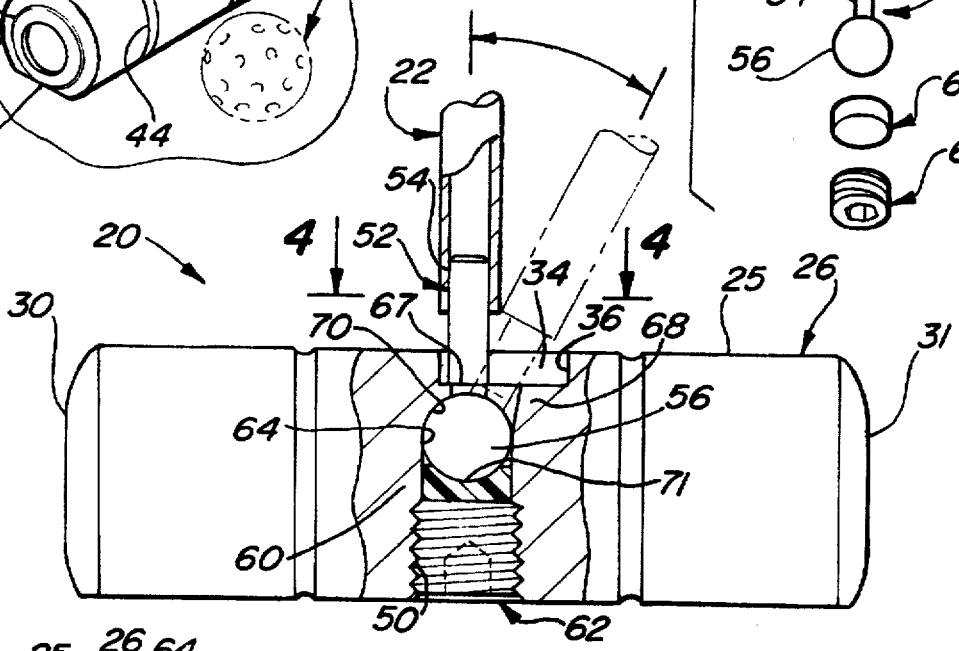
FIG. 3 is a side view partially broken away of the putter of FIG. 1.

As can be seen in FIG. 3, the ball portion 56 of the rotatable member 52 is rotatably disposed within a midportion 64 of the bore 34. The stem portion 54 of the rotatable member 52 extends through the upper portion 36 of the bore 34 and protrudes above the upper surface 25 of the head 26, where it is inserted into the shaft 22. The upper portion 36 of the bore 34 is longitudinally elongated towards one longitudinal end 31 of the head 26. The upper portion 36 of the bore 34 includes a vertical first abutment surface 67 at one longitudinal end of said upper portion 36 and a sloped second abutment surface 68 at the opposite longitudinal end of said upper portion 36. The ball portion 56 of the rotatable member 52 is retained within the midportion 64 of the bore 34 by a shoulder 70 formed in the upper portion 36 of the bore 34. A concave face 71 of the ball joint retainer 60 frictionally engages the ball portion 56 of the rotatable member 52. The retainer 60 can be loosened or tightened by the threaded locking member 62 which is threaded into the threaded portion 50 of the bore 34. The retainer 60 is resilient and thus holds member 52 at a selected position during putting or transport of the putter. Since retainer 60 is resilient, it allows adjustment of the position of member 52 without loosening locking member 62. Rather, a golfer can apply weight or force and the resilient retainer 60 allows adjustment. After the weight or force is removed, the retainer 60 returns to its original holding position. This feature allows a golfer to adjust the angle as by leaning on the head through the shaft. the golfer may thus tailor the angle for the individual green slope.

Figure 4:
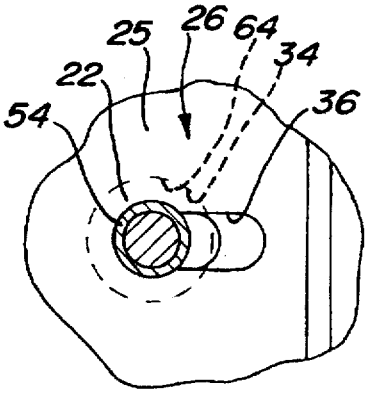
FIG. 4 is a top view of a portion of the putter of FIG. 3 taken along line 4—4.

As can be seen in FIG. 4, upper portion 36 of the bore 34 is narrower than the midportion 64 of the bore 34. The upper portion 36 is preferably only slightly wider than the stem portion 54 of the rotatable member 52 or the shaft 22.

When adjustment of the head angle is desired a force is applied and the ball portion 56 rotates within the midportion 64 of bore 34 on ball joint retainer 60. As mentioned above, the locking member 62 may be loosened during this adjustment but due to resilient retainer 60, this is not necessary. The stem portion 54, and therefore the shaft 22 of the putter 20, can pivot freely between roughly 30 degrees and 90 degrees relative to the axis of the head 26. At roughly 90 degrees, the shaft 22 abuts the first abutment surface 67 in the upper portion 36 of the bore 34. At roughly 30 degrees, the shaft 22 abuts the second abutment surface 68 in the upper portion 36 of the bore 34. The narrower upper portion 36 acts as a guide, preventing pivotal movement of the shaft 22 about the axis of the head 26. After moving the shaft 22 to the desired angle relative to the axis of the head 26, the golfer releases the force. If locking member 62 has been loosened, it is again tightened.

The shaft 22 is prevented from pivoting about the axis of the head 26 by the upper elongated portion 36 of the bore 34. Further, the convex faces 32 ensure that proper line contact with the golf ball 46 will occur even if the golfer slightly rotates the shaft 22 about the axis of the head 26. Because the head 26 includes convex faces 32 on both sides of the head 26, the putter 20 can be used by both right-handed and left-handed golfers.

Figure 5:
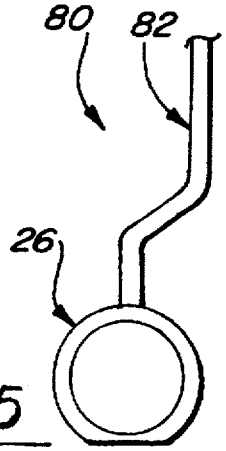
FIG. 5 is a front view of an alternative putter of the present invention.

As can be seen in FIG. 5, an alternative putter 80 according to the present invention includes an offset shaft 82 pivotally secured to the head 26.

Figure 6:
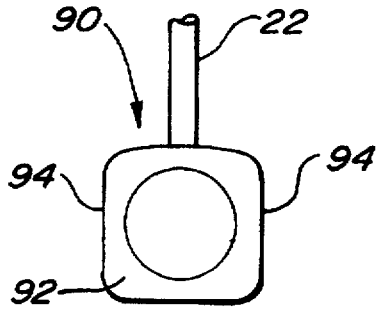
FIG. 6 is a perspective view of another alternative putter of the present invention.

As can be seen in FIG. 6, another alternative putter 90 according to the present invention includes a shaft 22 pivotally secured to an alternative head 92 having a pair of flat faces 94.

In accordance with the provisions of the patent statutes, the present invention has been described in what is considered to represent its preferred embodiment. However, it should be noted that the invention can be practiced other, vise than as specifically illustrated and described without departing from its spirit or scope.

What is claimed is:

1. A golf club comprising:

a shaft having a lower end;

an elongate head having a longitudinal axis, an upper surface, and a bore having a longitudinally-elongate upper portion extending to an opening in said upper surface;

a rotatable member rotatably disposed within said bore;

a portion extending from said rotatable member through said upper portion, said upper portion of said bore restricting the pivotal movement of said shaft relative to said head generally to a single plane;

a locking member selectively preventing pivotal movement of said golf club shaft relative to said golf club;

said upper portion of said bore restricting the pivotal movement of said shaft relative to said head generally to a plane containing an axis of the shaft and the axis of said head, said rotatable member including a spherical portion; and said locking member resiliently locking said rotatable member.

2. The golf club of claim 1 wherein said golf club head includes a convex face.

3. The golf club of claim 1 wherein said golf club head is generally cylindrical.

4. The golf club of claim 1 wherein said upper portion prevents the pivotal movement of said shaft past a position generally perpendicular to said axis of said golf club head.

5. A golf club comprising:

a shaft having a lower end and an axis;

an elongate head having a longitudinal axis and an upper surface, said lower end of said shaft pivotally coupled to said upper surface of said head;

a guide structure guiding said shaft during pivotal movement about said axis of said head;

a resilient locking member selectively preventing or permitting pivotal movement of said shaft relative to said head; and a pivotal member disposed in a bore in said head, said pivotal member retained in said bore against a shoulder by said resilient locking member, said resilient locking member having a curved portion in at least one plane, and said pivotal member being curved in said plane such that said resilient member can accommodate pivotal movement of said pivotal member in said plane.

6. The golf club of claim 5 further including:

a spherical member disposed within a bore in said head, said spherical member retained within said bore by a shoulder within said bore, said bore having a longitudinally elongate upper portion; and a portion extending from said spherical member through said upper portion of said bore.

7. The golf club of claim 5 wherein said golf club head includes a convex face.

8. The golf club of claim 5 wherein said guide structure prevents the pivotal movement of said shaft past a position about 90 degrees relative to said axis of said golf club head.

9. The golf club of claim 5 wherein said guide structure restricts the range of pivotal movement of said shaft generally between about 30 to about 90 degrees.

10. The golf club of claim 5 wherein a non-resilient threaded member applies a locking force through a resilient member to provide said locking member.

11. The golf club of claim 5 wherein said pivotal member is spherical and said curved portion of said resilient member is spherical.

12. A method for adjusting the angle of a golf club shaft relative to a golf club head having a longitudinal axis and an upper surface including the steps of:

(a) providing a resilient locking member;

(b) applying a force and moving said shaft pivotally about an axis perpendicular to said longitudinal axis of said golf club head, said shaft extending from said upper surface of said golf club head;

(c) restricting said pivotal movement of said shaft relative to said head generally to a plane containing said axis of said shaft and said longitudinal axis of said head; and (d) releasing said force.

13. The method of claim 12 further including the step of restricting the range of said pivotal movement of said shaft generally between about 30 to about 90 degrees.

14. The method of claim 12 further including the step of rotating a spherical member disposed within a bore in said golf club head and secured to said shaft.

15. The method of claim 12 further wherein said step (a) further includes tightening a threaded fastener through a resilient member against said spherical member to prevent rotation of said spherical member.

* * * * *